United States Patent [19]

Erickson

[11] Patent Number: 4,537,380

[45] Date of Patent: Aug. 27, 1985

[54] NEEDLEWORK PATTERN BOOKLET HOLDER

[75] Inventor: Edward C. Erickson, Crete, Ill.

[73] Assignee: Sales Tools, Inc., Des Plaines, Ill.

[21] Appl. No.: 502,488

[22] Filed: Jun. 9, 1983

[51] Int. Cl.[3] ..... A47B 97/04

[52] U.S. Cl. ..... 248/460; 40/341; 248/462; 281/33

[58] Field of Search ..... 248/460, 461, 462, 466, 248/472; 40/352, 351, 341, 10; 281/33

[56] References Cited

U.S. PATENT DOCUMENTS

| | | | |
|---|---|---|---|
| 896,753 | 8/1908 | Peterson | 248/460 |
| 2,434,860 | 1/1948 | Oxley | 248/460 |
| 2,776,150 | 1/1957 | Ericson | 281/33 |
| 3,152,580 | 10/1964 | Tinsley | 40/352 |
| 3,269,043 | 8/1966 | Swanson | 40/102 |
| 3,376,009 | 4/1968 | Domino | 248/460 |
| 3,450,420 | 6/1969 | Smith | 281/33 |
| 3,724,876 | 4/1973 | Krikorian | 281/33 |
| 4,296,946 | 10/1981 | Larre et al. | 281/33 |
| 4,420,270 | 12/1983 | Rossello | 281/33 |

*Primary Examiner*—William H. Schultz
*Assistant Examiner*—Ramon O. Ramirez
*Attorney, Agent, or Firm*—McWilliams, Mann, Zummer & Sweeney

[57] ABSTRACT

A needlework booklet holder comprising front and rear panels that are comparable to those of looseleaf notebook binders, and with the front and rear panels being associated with a magnetic material containing mounting panel, that overlies the inside surfacing of the rear panel, and a rigid brace plate in the form of an angle member having its sections at approximately 120 degrees, with the mounting panel and one of the brace plate sections being anchored to the holder rear panel along its inner edge, and the holder front and rear panels being hinged about a swing axis that is positioned adjacent the front panel inner edge, whereby when the front and rear panels of the holder are swung about the swing axis from an essentially flat, closed relation to open the holder for use, the holder rear panel and the mounting panel itself are disposed in easel forming, upwardly inclined relation relative to the front panel to receive and mount the pattern booklet in three possible positions for appropriately disposing the pattern for following by the user with the aid of a straight edge that is in the form of a flexible rubber magnet strip that is provided for magnetic adherence to the holder panel in conformity with the grid of the pattern.

10 Claims, 10 Drawing Figures

NEEDLEWORK PATTERN BOOKLET HOLDER

This invention relates to a holder for needlework pattern booklets, and more particularly to a holder for such booklets to conveniently hold the booklet with a choice of orientation that permits the needlework stitcher to dispose the design selected in an easel like working position, with a straight edge being operably associated therewith for use relative to the design grid, for ready copying of the design on unprinted embroidery fabric therefor.

It has become common practice for the designers of needlework designs, as provided for guidance in needlepoint, crewel, cross stitching, and the like work, to incorporate in a booklet, for use by practitioners of the embroidery arts, selected designs, in which booklets the several sheets involved that contain representations of the designs provided, instructions, color coding, and the like, are stapled together across like center axes of the sheets to form the booklet pages that open in the usual paper back booklet manner by being swung from right to left about the resulting folded and hinging sheet connection at the back edging of the booklet.

The needlework designs provided by such booklets have the designs delineated on a grid made up of horizontal and vertical lines, which grids are typically subdivided into squares of larger uniform dimension, such as one inch, by intersecting relatively dark or wide horizontal and vertical lines, and further subdivided, by intersecting light or thin horizontal or vertical lines into smaller squares of uniform dimension, such as 1/10th inch squares, or squares that are 1/10th of an inch on a side. The grid represents the warp and woof threads of the woven fabric to which the design provided is to be applied if so selected by the individual wishing to do the embroidery work. The needlework stitcher applying such a selected design to a woven fabric suitably adapted for this purpose, typically applies the fabric to be embroidered to an embroidery hoop, with the fabric being oriented relative to the hoop so the warp and woof threads of the fabric are disposed horizontally and vertically of the fabric portion to be embroidered; the embroidery stitches are applied to the fabric portion being embroidered at the location corresponding to the location indicated on the design grid, as determined by the adjacent horizontal and vertical lines of the grid that the selected design is delineated on (as the design appears in the booklet kit containing a selection of such designs).

This type of handwork requires the use of both hands by the person doing the embroidery work, and thus the booklet containing the design that has been selected for application to the embroidery fabric has to be disposed by itself adjacent the worker, as by being laid flat on a table or other piece of furniture suitably positioned adjacent the worker for that purpose, or by being some how propped on such a support for more ready viewing by the worker, in serving as the guide to the worker in performing the desired embroidery work.

A principal object of the invention is to provide a holder for needlework design containing booklets and the like that comprises front and rear cover panels and a mounting panel for mounting the design booklet easel fashion adjacent the worker, in which the booklet holder can be folded up essentially flat, and with the design containing booklet contained inside same, with the holder itself being arranged so that when the needlework is to be done following one of the designs of the booklet, the cover panels may be unfolded or swung into a relationship in which one of the cover panels forms a supporting base for the booklet holder, and the other cover panel and the device mounting panel form a composite easel to which the design containing booklet may be applied, without marring the booklet in any way or employing pins or adhesive for this purpose, and with the booklet pages turned to expose the design selected, may be applied, with the design oriented in the upright position intended for same, regardless of the vertical or horizontal orientation of the selected design in the booklet, for effective observation and use by the worker.

Another principal object of the invention is to provide a holder for needlework design containing booklets and the like involving a notebook like cover panel arrangement that folds essentially flat when not in use, and that contains a booklet mounting panel that is positioned easel fashion when the holder is opened up and arranged for use, with the holder mounting panel being in the nature of a holder or mounting flap that is anchored at its base and is proportioned to receive and hold the design containing booklet in three basic positions of orientation for disposing the grid of the design selected in proper vertical-horizontal orientation for effectively working with the selected design, with the mounting or holder flap having magnetic characteristics that are substantially coextensive therewith for application to the selected design of a straight edge defining stripping of magnet material, for use of the straight edge in association with the grid of the selected design, as an aid to guiding the worker in applying the selected design to the embroidery fabric being worked on.

Other objects of the invention are to provide a needlepoint design booklet holder that comprises few and simple parts, that accommodates design containing booklets of varient sizes and shapes, that requires no great amount of experience in needlework to use, and that is economical of manufacture, convenient to use and store when not in use, and requires no change in conventional design providing booklets, the designs themselves, or the grids therefor, for effective use by embroidery enthusiasts.

In accordance with the present invention, a needlework design pattern booklet holder is provided that comprises front and rear panels that are comparable to those of conventional looseleaf notebook binders, with the front and rear panels being associated with a magnetic material containing mounting or holder panel, that overlies the inside surfacing of the holder rear panel, and a rigid brace plate in the form of an angle member having two planar sections extending longitudinally of the brace plate and disposed at an obtuse angle that approximates 120 degrees. In the holder arrangement involved, the mounting or holder panel and one of the brace plate planar sections are anchored to the holder rear panel along its inner or back edge, and the front and rear panels are hinged together about a swing axis that is positioned to be spaced from the internal corner that is defined by the brace plate a distance that is across and at least equals the width of the other brace plate section. The arrangement is such that when the holder front and rear panels are swung about the indicated swing axis from an essentially flat, closed relation, to open the holder, the holder rear and mounting panels are disposed in easel forming, upwardly inclined, relation relative to the front panel that is disposed so as to serve as a broad flat base for the holder, with the mounting panel serving as the mounting or holder leaf of the holder, and being arranged to provide for ready mounting of the design pattern booklet with the booklet open to the selected design, in three possible positions for appropriately disposing the selected design pattern for following by the user, with regard to correct orientation of the design grid, horizontally and vertically, and in association with a straight edge formed from magnet material that is applied by the worker against the face of the booklet sheet or page bearing the design, for ready following of the design grid horizontal and vertical lines, and specifically the stitching the design suggests at any particular location across the design grid.

Other objects, uses, and advantages will be obvious or become apparent from a consideration of the following detailed description and the application drawings in which like figures indicate like parts throughout the several views.

In the drawings:

FIG. 1 is a diagrammatic perspective view illustrating one embodiment of an embroidery design pattern booklet holder arranged in accordance with the present invention, with the holder shown in its booklet mounting and holding position, and the straight edge that magnetically cooperates with the holder mounting panel being illustrated in its operative position against the face of the booklet page which bears the selected design to be applied to the fabric to be embroideried;

Figure 1:
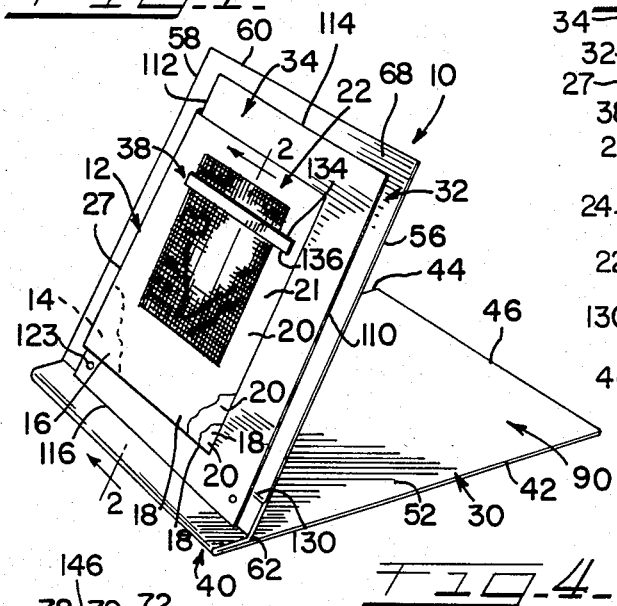

However, it is to be distinctly understood that the specific drawing illustrations provided are supplied primarily to comply with the requirements of the Patent Laws, and that the invention is susceptible of modifications and variations that will be obvious to those skilled in the art, and that are intended to be covered by the appended claims.

Reference numeral 10 of FIGS. 1–6 generally indicates one embodiment of the invention that is arranged to mount and hold for use, by one desiring to apply an embroidery design to a woven fabric suitable for that purpose (as well known in the embroidery arts), a booklet 12, which is intended to be representative of one of the numerous types of such booklets that are available to those interested in embroidering work that are sources of embroidery designs which are offered as selections to suit the worker's fancy, as might be desired for application to the woven fabric.

The booklets 12 are commonly available at shops dealing in embroidery materials, an example of which is the needlepoint booklet entitled "Little Inspirations", authored by Banar Designs, P.O. Box 483, Fallbrook, Calif. 92028.

These booklets typically contain a cover sheet and a number of inside sheets which are center folded down the vertical center line of the sheets and stapled together along such center line to form the booklet into individual pages. The inside sheets typically bear one or more embroidery designs applied to an orientation grid that is defined by intersecting horizontal and vertical lines that are intended to represent the warp and woof of the cloth that is to be embroideried. The inside sheets of the booklet forming the inside pages are arranged so that on each page one or more of such designs appears together with color coding that is involved in the design. The cover sheet of the booklet forms the cover front and back pages that typically bear on the inside surfaces of same appropriate instructions for both stitching and framing purposes, identification of the authorship of the designs etc.

The booklets 12 are employed in embroidery work by the individual turning through the booklet to locate the design that is desired to be applied in the embroidery operation, with the booklet then being fully opened at the page bearing the desired design. In the use of the booklet 12 in accordance with prior art practices, the book as opened up to the desired design normally is laid flat on a table or the like adjacent the person doing the embroidery work with the desired design facing upwardly, and the one doing the embroidery work endeavors to stitch the embroidery fabric following the design specifics and color coding of the selected embroidery design in question. Typically the fabric being embroideried is applied to an embroidery hoop of a standard design and diameter and the individual designs of the booklet 12 have a dashed line showing or the like of the diameter of the hoop about the design offered for embroidery purposes. The embroidery fabric is to be applied to the hoop so that its warp and woof threads have the same orientation as the horizontal and vertical lines of the design grid of the booklet. Typically the designs offered for selection have the embroidery work involved as suggested by the design within the confines of the diameter of the embroidery hoop, as indicated in dashed lines or the like on the design grid, and the person doing the embroidering applies the stitching suggested by the design to the warp and woof threads of the fabric in the location indicated by the booklet design being copied in accordance with the location of each stitch or cross stitch as indicated by the grid on which the design is applied.

Figure 3:
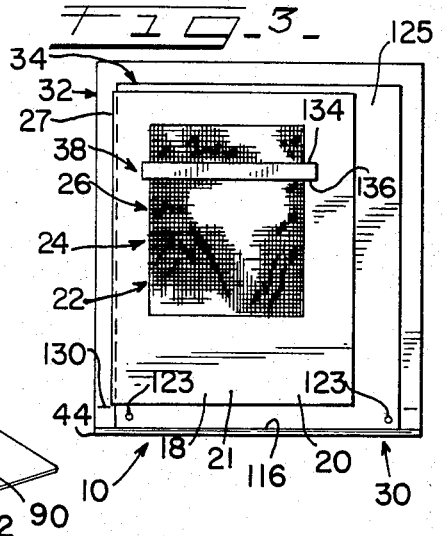
FIG. 3 is a front view of the holder of FIGS. 1 and 2 showing the holder mounting the design containing booklet in one position of orientation of the booklet.
Figure 9:
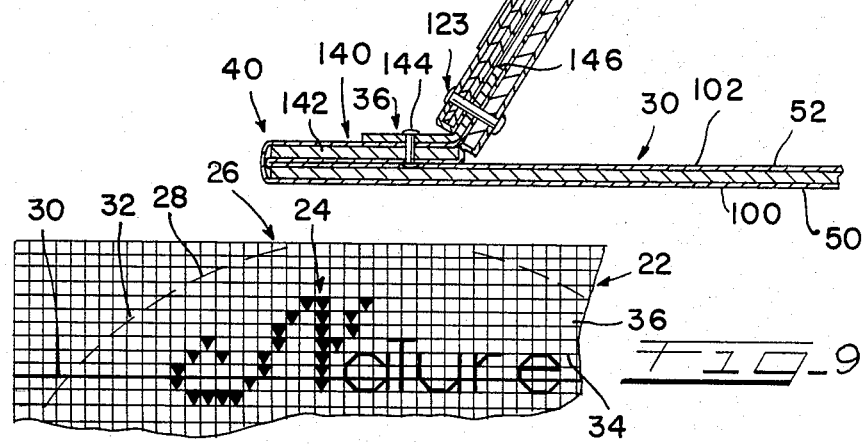
FIG. 9 is a fragmental plan view illustrating the general nature of the design patterns that typically are available in booklets of the type illustrated in FIGS. 1,3–5, and 7.

The booklet 12 thus comprises cover sheet 14 (shown only fragmentally and in phantom in FIG. 1, but see FIG. 2) that defines the front or cover page 16 and rear or back page 15, with the cover sheet 14 in practice being folded over a number of similarly folded inside sheets 18 to define individual pages 20 each bearing an individual and usually different embroidery design and grid combination, one of which is indicated at 22 in FIGS. 1 and 3. Each embroidery design and grid combination 22 comprises (see FIG. 9) a specific embroidery design 24 in the form of suitable indicia indicating lettering, shapes and the like that are to be formed by stitching in accordance with embroidery principles and applied to the grid 26. In the fragmental view of FIG. 9, a portion of a typical design grid composite 22 is illustrated, in which the embroidery hoop indicating circle appears as dashed line 28, and the grid 26 is made up of relatively dark or thick vertical and horizontal grid lines 32 that intersect to form a grid subdivision of larger dimensions, such as one inch, and a multiple of relatively thin or light intersecting horizontal and vertical grid lines 36 that form smaller subdivisions, such as squares of 1/10th of an inch. The design 24 that is to be followed in doing the embroidery work is thus delineated on the grid 26, and specifically as to the grid horizontal and vertical lines, in the manner suggested by FIG. 9, which the person doing the embroider work relates to the warp and woof threads of the fabric in the hoop in applying the stitching suggested by the selected design to the embroidery fabric that is appropriately mounted in the hoop in accordance with standard practices so that the design grid and the warp and woof threads of the fabric are congruently related insofar as the work the person doing the embroidery processing is to do in applying the design to the fabric.

As an aid to the person doing the embroidery work, it is common practice to employ a straight edge or ruler, which lined up with the various horizontal lines of the grid 26, so that the person doing the embroidery work involving the design can systematically and sequentially make the individual stitchings by following what is shown in design that is to be applied along the individual horizontal grid lines, in order to fully apply the design to the embroidery fabric. Of course, where the ruler or straight edge is employed, the booklet 12 must be laid flat with the page 20 bearing the design 24 that has been selected exposed, and with the booklet laid flat approximately horizontally for observation by the worker, with the straight edge moved and placed by hand as needed as the work progresses. For this purpose the booklet is either laid open flat at the page 20 bearing the desired design, or it, is folded over flat, with the front or back cover page and inside pages preceding the page 20 bearing the design in question (depending on whether the design is on the front or back side of the page 20), folded over in back of such page, so that the booklet may be laid flat to expose the desired design composites 22 of the page 20 in question.

The various design and grid combinations 22 that appear in such a booklet 12 are oriented with respect to the page 20 to which they are applied in basically one of three manners. Such design composites 22 may be applied to the front side 21 of the page 20, in which case the booklet 12 is opened and laid flat so that the front side 21 of the page 22, which bears the design 22 in question, is exposed and faces the worker (note the booklet 12 opened as shown in FIGS. 1 and 3). The design composite 22 may also be on the back side 23 of the page 20 with the grid 26 thereof having the same orientation with regard to the page back side 23, in which case the booklet 12 is open to be laid flat (on a table or the like) with the page surface 23 facing upwardly (not the booklet 12 opened as shown in FIG. 3).

Figure 5:
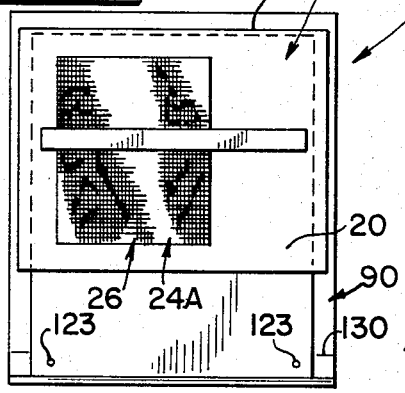
FIG. 5 is similar to FIGS. 3 and 4, but illustrates the booklet at a third position of orientation in its reception on the mounting panel, it being applied over the top of the holder mounting panel in the showing of FIG. 5, with still a different embroidery design being involved.

The booklet 12 may also have the design-grid composite 22 applied to a page 20 so oriented that the top part of the design 24 involved, as well as the top of the grid 26 lies at or adjacent the center fold 27 of the booklet (note the booklet 12 opened as shown in FIG. 5), this design and grid orientation being possible on both sides of the page 20. For working with designs having such center fold alignment orientation with regard to the booklet 12, the booklet 12 typically is opened to the selected design and laid flat on a table or the like with the center fold 27 extending horizontally (for this purpose the booklet 12 may be fully opened and laid flat at the selected design, or doubled over at the center fold 27 to expose only the page side of the page 20 of the booklet that bears the selected design, and then laid flat on the table or the like with the selected design facing upwardly.

The design booklet holders 10 and 10A of the present invention are arranged to not only mount and hold the booklet 12 to dispose the selected design and grid composite 22 in an upright and convenient, easel like manner, but also to accommodate these three basic manners of orientation of the booklet designs so as to have the same sort of mounted positions for the booklet even though the selected design may be on the front or rear sides of one of the booklet pages, or may be center fold oriented, as suggested by FIG. 5.

The design booklet holder 10 (see FIGS. 1–6) generally comprises front cover panel 30, rear cover panel 32, mounting or holder panel 34, a rigid base plate 36 of angle shaped configuration (see FIG. 2A), and straight edge implement 38 that in accordance with the invention is magnetically associated with the mounting or holder panel 34.

The general arrangement of the front cover panel 30, the rear cover panel 32, and the brace plate 26 may per se be substantially as disclosed in Ericson U.S. Pat. No. 2,776,150, granted Jan. 1, 1957 (the disclosure of which is incorporated herein by this reference, see in particular the embodiment of FIGS. 1–4 of this patent). Following disclosure of said Ericson patent, the front or rear cover panels 30 and 32 and the brace plate 36 are operably associated so that the holder 10 in its closed position folds substantially flat, as indicated in FIG. 6, while in its open position it unfolds so that the front cover 30 forms the relatively wide and flat base support for the upwardly angled rear panel 32.

In accordance with the invention, the front and rear panels 30 and 32 are of composite construction and connected together for swinging movement between the open and closed positions about a hinging connection or articulation 40. The front cover panel 30 defines parallel side edges 42 and 44 that are in substantial parallelism, and outer edge 46 and inner edge 48 adjacent the articulation 40, which edges 46 and 48 are in substantial parallelism, whereby the front panel 30 is of generally quadrilateral configuration.

Figure 2:
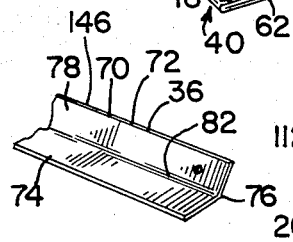
FIG. 2 is a fragmental vertical sectional view taken substantially along line 2—2 of FIG. 1, but on an enlarged scale, diagrammatically illustrating the component parts of the holder and its straight edge.
Figure 2A:
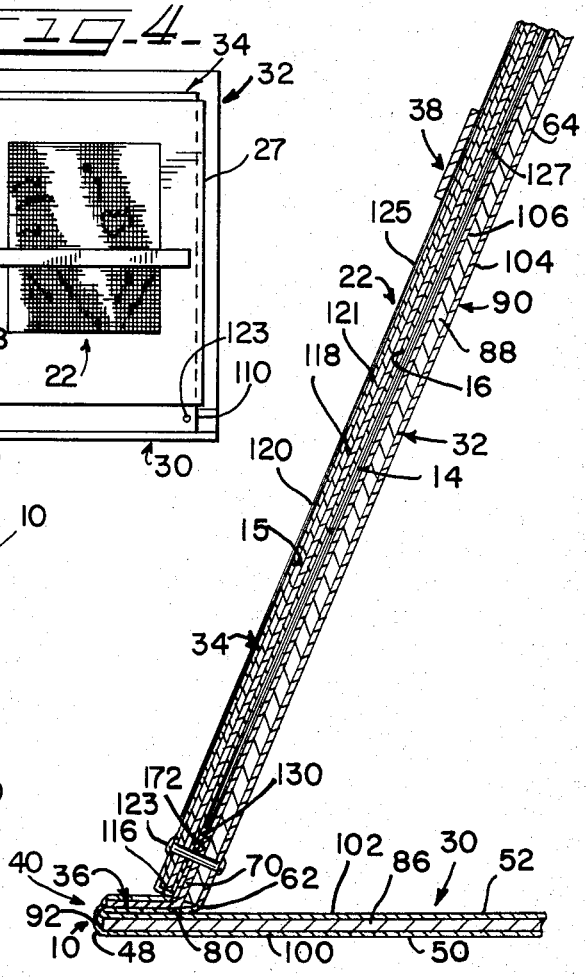
FIG. 2A is a fragmental perspective view of part of the holder brace plate.

The front panel 30 further defines inner side surfacing 50 and outer side surfacing 52. As indicated by the showings of FIGS. 2 and 6, the front panel outer surfacing 52 is disposed on the outside of the front panel 30 when the holder 10 is in its closed or folded up relation, but in the operative booklet mounting and holding relation of the holder, the inner surfacing 50 of the front panel is outwardly disposed and is the part of holder 10 that rests on the support for the holder 10, which typically is a table top or the like (not shown).

Figure 6:
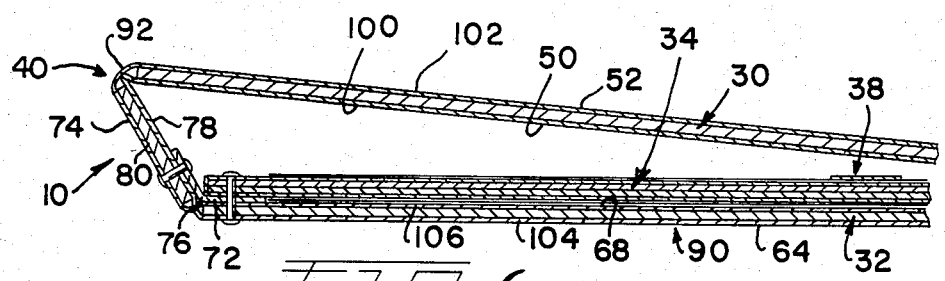
FIG. 6 is a view of the holder of FIGS. 1–5 that is similar to FIG. 2, but is on a reduced scale and shows the holder in its folded up or shut position.

The rear panel 32 defines side edges 56 and 58 that are in substantial parallelism, outer free edge 60, and inner edge 62, with the edges 60 and 62 also being in substantial parallelism, whereby the rear panel is also generally quadrilateral in configuration and defines outer side surfacing 64 and inner side surfacing 68, with the outer side surfacing 64 being exposed when the holder 10 is in its folded up or retracted relation (see FIG. 6).

Figure 4:
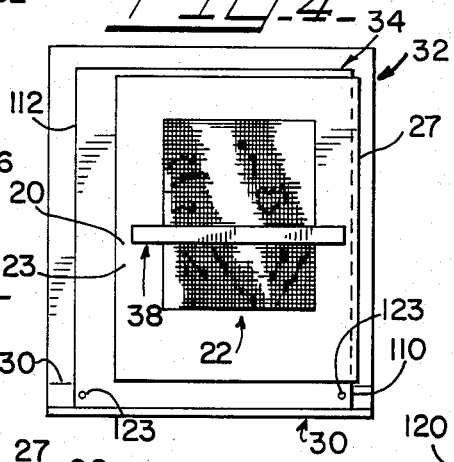
FIG. 4 is similar to that of FIG. 3, but shows the design booklet mounted at a different position of orientation on the other side edge of the holder mounting panel, with a different design being illustrated.

The brace plate 36 comprises elongate angle member 70 (see FIG. 2A) that has a length approximating the width of the respective panels 30 and 32 (the horizontal dimension of FIGS. 3–5). As shown more specifically in FIG. 2A, the angle member 70 comprises a pair of planar sections 72 and 74 that extend longitudinally of the brace plate 36 and merge together in integeral fixed relation at apex 76 which is medially or centrally located along the length of the brace plate 36. Sections 72 and 74 are disposed at an obtuse angle, which for purposes of the present invention is in the range of from about 110 to about 130 degrees, and preferably approximately 120 degrees. The brace plate 36 defines front side surfacing 78 and back side surfacing 80, with said sections 72 and 74 being angled at said apex 76 forwardly of the member 70. It will be noted that the member 70 along the apex 76 defines internal corner 82 that extends the length of the member 70.

In the arrangement of the holder 10, the front and rear panels 30 and 32 are of composite arrangement. The front panel 30 comprises core 86 that may be formed by a sheet of composition board, such as cardboard, hardboard, or the like, while the rear panel 32 has a similar core 88. The angle member 70 is applied at the inner edge 62 of the rear cover panel by having its section 72 seated against the corresponding edge of the core 88, as indicated in FIGS. 2 and 6, and fixed thereto in any suitable manner, as by employing riveting, suitable bonding or adhesive substances, or the like, or the alternate arrangements shown in FIG. 2 which will be described hereinafter. The angle member 70 is disposed relative to the inner edge 62 of the rear cover panel 32 so that its section 74 projects away from the plane of panel 32 at the aforementioned obtuse angle. As indicated in FIG. 2, the panel cores 86 and 88 have applied to same across their inner and outer surfacings and about their side and end edges a suitable sheathing 90 which sheaths or covers both the cores 86 and 88, and is continuous across the articulation 40 to form the cover flexing joint 92 at such location, whereby the front or rear covers may be swung about the swinging axis defined by the articulation 40 between the relations of FIGS. 2 and 6.

The sheathing 90 may be of any suitable type such as a finishing covering of fabric, leather, plastic sheeting or the like to define for the panel 30 external layers 100 and 102, and for the panel 32 external layers 104 and 106, with the sheathing 90 in the area of the brace plate 36 being arranged to have the layers 100 and 106 integral and in overlying relation to the angle member front side surfacing 78, and the layers 102 and 104 integral and in overlying relation to the angle member back side surfacing 80, as indicated in FIGS. 2 and 6. Various manners of securing the sheathing 90 to the respective cores 86 and 88 may be employed, as will be apparent to those skilled in the art, though for manufacturing expediency and economy, it is preferred to use adhesives since the joinder between the sheathing materials and the cores and angle member 70 may be effected by passing the same through suitable pressure applying rollers, thus smoothly and evenly disposing the sheathing material over and in suitable adhesive bonding relation with the respective cores and angle members 70, respectively.

The mounting or holding panel 34, in accordance with the invention, has a shaping and is formed in a manner similar to the panels 30 and 32. Thus, panel 34 defines substantially parallel side edges 110 and 112, outer edge 114, and inner edge 116, with the outer and inner edges 114 and 116 being in substantial parallelism; the mounting or holding panel 34 is therefore also of generally quadrilateral configuration, though in the form of FIGS. 1–6 it is somewhat smaller in length and width than rear panel 32.

The panel 34 in make up is composed of core 118 and sheathing 120, with the core 118 of the holder 10 comprising a sheet of magnetic metal material, such as a suitable gauge of sheet metal of appropriate iron composition or other material of suitable magnetic attraction capabilities, while the sheathing 120 may be of one of the types mentioned for sheathing 90, with the sheathing 120 and core 118 being suitably bonded together, as by employing appropriate adhesive or bonding materials in the same manner as for panels 30 and 32. Sheathing 118 defines for panel 34 external layers 121 and 123 that fully cover the faces and edges of core 118.

The panel 34 along its inner edge 116 is supplied in overlying relation to the brace plate 36, and specifically with respect to the angle member planar section 72, as indicated in FIGS. 1, 2 and 6, with the panel 34 being disposed in squared relation with the angle member 70, and with the inner edge 116 of the panel 34 being in substantial parallelism with the member 70 and located adjacent its internal corner 82.

The mounting or panel member 34 is anchored to the rear panel 32 and the brace plate 36 by employing suitable rivets 123 at spaced locations along the base plate flange 72, such as the pair of rivets 123 indicated in FIGS. 1 and 3–5, with the rivets 123 passing through both the panels 34 and 32 as well as the brace plate planar section 72 as indicated in FIGS. 2 and 6.

The holder 10 thereby provided thus provides the rear panel 32 with the angled brace plate 36 anchored thereto at its inner edge 62, and with the brace plate 36 covered by the sheathing 90 over its front side surfacing 78. The panel 34 adjacent the angle member 70 is thus spaced from the panel 32 the thickness of the angle member section 72 plus the thickness of the sheathing material overlying same, thereby defining a shoulder or shelf 130 that extends transversely of the panel 34 and in substantial parallelism to its inner edge 116 and the angle member 70. The mounting panel 34 extends from the angle member 70 toward the outer edge 60 of the panel 32, where the outer edge 114 of panel 34 may engage the inner surfacing 68 of the rear panel 32, but is free of fixed connection thereto.

The straight edge implement 38 is formed from a strip of magnet material, and in the preferred form of the invention the implement 38 is formed from the flexible rubber magnetic strip product offered by Adams Magnetic Products, 4547 West Addison, Chicago, Ill., or its equivalent. This commercially available strip product is composed of rubber material that is magnetized and available in 0.030 inch and 0.060 inch thicknesses, may readily cut or slit to size as desired, and is made by, for instance, Minnesota Mining & Manufacturing Co., St. Paul, Minn., General Tire and Rubber Co., Akron, Ohio. The implement 38 being formed from a length of such material, it has magnet qualities and is in strip form to define upper and lower straight or rectilinear edges 134 and 136 therealong that are in parallel. The straight edge implement 38 when placed against the front face or surfacing 125 of the mounting panel 34 adheres thereto by way of magnetic attraction to the core 118 of same. The straight edge implement 38 thus remains adhered in place against the front face 125 of the mounting panel 34, but can be readily moved by finger gripping of same, or finger pressure against same, to any location desired with respect to the front face of panel 34.

The holder 10 is employed with regard to a booklet 12 by selecting in the booklet 12 the desired design 24 to be applied to a particular embroidery fabric, after which the booklet bearing such design is folded flat for application to the holder 10, which is unfolded from the position of FIG. 6 to the easel defining position of FIG. 2 for this purpose. If the selected design and its associated grid 26 are on the front side 21 of a page 20 thereof, the pages of the booklet 12 in front of the page 20 in question, including the front cover page 14, are folded in back of the page 20 in question, to the familiar U shaped configuration, and the thus folded or doubled over booklet is slipped over the mounting panel 34 from its side edge 112, with the lower edge of the back folded booklet pages being brought to rest on the shoulder 130 defined by the rear panel 32 along its inner surfacing 68. This results in the booklet and the selected design being disposed as indicated in FIGS. 1–3, and the user then places the holder 10 on a suitable table or the like adjacent his chair or other suitable place of work and following conventional embroidering techniques, applies the design indicated by the selected design 24 to the embroidery fabric.

With the booklet 12 in place,on mounting panel 34 in the manner indicated in FIGS. 1 and 3, the straight edge implement 38 may be applied to the design grid 26 with either its upper straight edge 134 or its lower straight edge 136 lined up with the appropriate horizontal line 30 or 34, for guiding the worker in pinpointing the appropriate location for the individual stitches to be made. One manner of embroidering commonly used is to start at the middle of the design and work upwardly and downwardly, and accordingly the straight edge implement 38 is moved in the same manner between adjacent horizontal lines 30 and 34 as needed to guide the worker.

In the showing of FIG. 4 the selected design is on the back side 23 of the selected booklet page 20, and accordingly the booklet is folded flat in doubled over relation against itself to expose the page side 23, and inserted the mounting panel 34 over its edge 110, and rested on shoulder 130.

Where the selected design of a booklet page 20 is oriented with respect to such page 20 so that the design horizontal grid lines parallel the booklet center fold 27, the booklet is folded in doubled over relation to expose the indicated page 20 bearing the design in question, and is applied over the top of the mounting panel 34, that is over its outer edge 114, as indicated in FIG. 5, with the folded back portion of the booklet disposed between the mounting panel and the rear panel 32. Where such selected design is on the front side 21 of such page 20, the front cover page 16 and booklet pages in front of same are at the back side or face 127 of mounting panel 34; where the design selected is on the rear side 23 of such page 20, the back cover page 15 and pages normally covering same are at the back side of face 127 of mounting panel 34.

Figure 7:
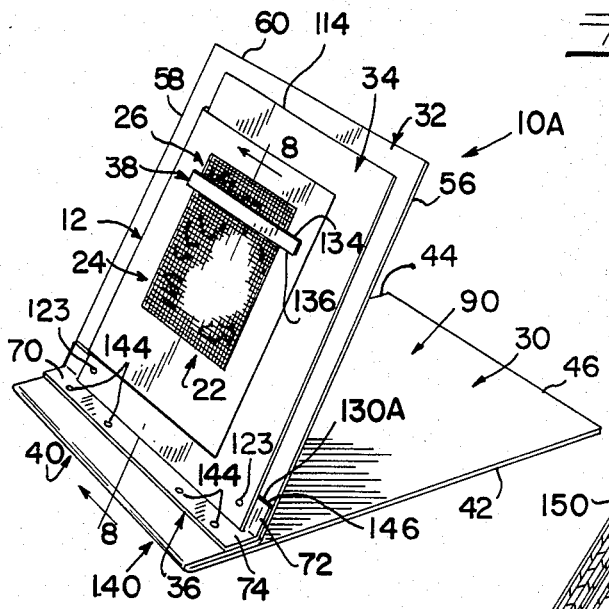
FIG. 7 is a view similar to that of FIG. 1, but illustrating a modified holder arrangement.
Figure 8:
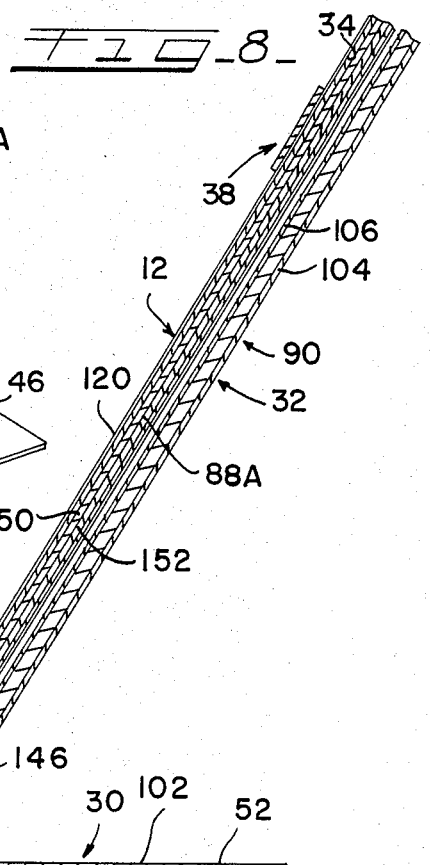
FIG. 8 is a view similar to that of FIG. 2, but showing the embodiment of FIG. 7, being taken substantially along line 8—8 of FIG. 7.

The holder 10A of FIGS. 7 and 8 is similarly arranged, and corresponding reference numerals indicate corresponding parts. In the holder 10A, the brace plate 36 is applied externally of the sheathing 90, and the front panel 30 is extended well beyond the section 74 of the angle member 70. A back cover panel 140 is provided between the front panel 30 and the rear panel 32 by providing a relatively short core strip 142 that is disposed between the inner end 62 of the rear panel and the inner end 48 of the front panel, with core 142 being the same as cores 86 and 88. The core 142 is incorporated in the sheathing 90 in the same manner as hereinbefore suggested, with the articulation 40 now being defined between the back cover panel 140 and the front panel 30. The section 74 of angle member 70 is anchored to the back cover panel 140 by employing a plurality of suitable rivets 144, and the section 72 of the angle member 70 as well as the mounting panel 34 are anchored to the rear panel 32 employing the rivets 123. In this embodiment the edge 146 of the angle member section 72 forms the shoulder 130A, as indicated in FIG. 8.

In the holder 10A, the core 88A is in the form of a thin sheet 150 of steel suitable laminated to a stiffening backing 152 formed from chipboard or the like, which core 88A is fully enclosed in sheathing 90. The back panel 140 bears against the front panel 30 in the operative position of holders 10A, with this and the increased length of panel 30 that is involved providing for increased stability of said holder in its easel forming position.

The holder 10A is otherwise the same as holder 10.

It will therefore be seen that the invention provides a convenient way to mount embroidery designs that appear in the familiar booklets therefor for ready use by the worker. The device accommodates a three way positioning of the booklet for holding purpose, as needed by the positioning and orientation of the design and its grid on the respective booklet pages. When the booklet has once been applied to the mounting panel for the purpose of working with a particular design, it may remain in that position together with the magnetic straight edge implement 38, until the worker has completed the embroidery work. This can include the period where the worker has to put the work down and fold up and put away the holders 10 and 10A, which are effective to keep the mounted booklet 12 and magnetically associated straight edge implement 38 in the desired booklet open and embroidery use positions so that when the worker can return to the embroidery work, it is really a matter of unfolding the holder to the positions of FIGS. 1 and 8 to orient the design for proper working purposes. The straight edge implement 38, as indicated, also remains adhered in place against the face of the page 20 bearing the design, and need only be finger adjusted as needed to again start the stitching.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A needlework pattern booklet holder comprising: a front panel and a rear panel, said panels each being quadrilateral in configuration with each said panel defining parallel side edges along either side of same, inner edges that are in adjacency, and outer free edges, with said inner and outer edges being disposed generally normal of the respective panel side edges, said panels further each defining inner and outer side surfacings, an elongate rigid brace plate located adjacent said inner edges of said panels, said brace plate comprising two planar sections extending longitudinally of said brace plate and fixed together at a corner adjacent the median portion of said brace plate and disposed at an obtuse angle, said brace plate having a front side and a back side and said sections being angled at said corner forwardly of said front whereby said brace plate defines an internal apex along said corner at said front side thereof, with one of said brace plate sections overlying said inner edge of said rear panel in substantial parallelism thereto and along the inner side surfacing thereof with the brace plate back side facing said rear panel inner side surfacing, and with said inner edge of said front panel being hinged with respect to said brace plate other section along a swing axis that parallels said brace plate corner and that is spaced therefrom across and at least the width of said brace plate other section, a mounting panel of quadrilateral shape overlying the inner surfacing of said rear panel and defining opposite side edges paralleling the rear panel side edges, an outer edge that parallels said rear panel outer free edge, an inner edge paralleling said rear panel inner edge, and front and rear side surfacings, with said mounting panel inner edge overlying said brace plate one section across said brace plate front side thereof, and means for anchoring said brace plate one section and said mounting panel along said inner edge thereof to said rear panel in the area of said one brace plate section, with said mounting panel being free of fixed connection to said rear panel between said brace plate one section and said outer edge thereof for forming a quadrilateral holder flap for fold over receiving positioning thereon a pattern booklet optionally from either of said edges or said outer edge thereof, whereby when said front and rear panels of said pattern booklet holder are swung about said swing axis to bring said inner side surfacings in adjacency, said holder is in closed relation over said mounting panel front side surfacing, and when said panels are swung about said swing axis to set said brace plate other section in seated relation against the outside surfacing of said front panel adjacent said inner edge thereof, said holder front panel inner surface may be rested on a horizontal support to dispose said mounting panel and said rear panel in easel forming position for said reception of the pattern booklet across said holder pattern front and rear side surfacings and display of a selected pattern and grid therefor over said mounting panel front side surfacing, with the pattern booklet disposed in one of said positions to orient the horizontal lines of the selected pattern grid substantially horizontally across said mounting panel front side surfacing.

2. The needlework pattern booklet holder set forth in claim 1 wherein:

said mounting panel includes sheeting formed from a magnetic material, which sheeting is substantially coextensive with said mounting panel for application of a straight edge implement formed from magnet material to the mounting panel front side surfacing and the pattern displayed thereon for assisting the user to follow the selected pattern.

3. The needlework pattern booklet holder set forth in claim 2 wherein:

said mounting panel front and rear side surfacings are defined by covering material that encloses said magnet material sheeting.

4. The needlework pattern booklet holder set forth in claim 2 wherein:

said anchoring means comprises rivet means employed in spaced relation along said brace plate one section.

5. The needlework pattern booklet holder set forth in claim 2 wherein:

said brace plate one section forms a shelf between said mounting panel and said rear panel on which the portion of the pattern booklet that is received between said holder panel and said rear panel in said easel forming position of said holder rests, said shelf being substantially parallel to said mounting panel and outer edges for disposing the pattern of the booklet that is in said selected position over said mounting panel front side surfacing in squared relation to said mounting panel.

6. The needlework pattern booklet holder set forth in claim 2 wherein:

said inner and outer side surfacings of said front and rear panels are defined by flexible covering means secured thereto, said covering means overlying said front side of said brace plate and forming said swing axis adjacent said inner edge of said front panel.

7. The needlework pattern booklet holder set forth in claim 2 wherein:

said inner and outer side surfacings of said front and rear panels are defined by flexible covering means secured thereto, said brace plate overlying said covering means on the inner side surfacing of said rear panel, and including a back panel interposed between said inner edges of said rear and front panels with said covering means enclosing said back panel, and means for anchoring said brace plate other section to said back panel, said swing axis being between said front panel inner edge and said back panel portion adjacent thereto.

8. The needlework pattern booklet holder set forth in claim 7 wherein:

said back panel has a width and length that exceeds that of said brace plate other section by a predetermined amount, whereby when said holder is in its easel forming position said back panel bears against said front panel for increased stability of said holder panel in said easel forming position of said holder.

9. The needlework pattern booklet holder set forth in claim 2 wherein:

said obtuse angle lies in the range of from about one hundred ten degrees to about one hundred thirty degrees.

10. The needlework pattern booklet holder set forth in claim 2 wherein said swing axis is closely adjacent the margin of said brace plate other section.

* * * * *